US007997947B2

(12) United States Patent
Pollack et al.

(10) Patent No.: US 7,997,947 B2
(45) Date of Patent: Aug. 16, 2011

(54) DEEP WATER HYDROCARBON TRANSFER SYSTEM

(75) Inventors: Jack Pollack, Monte-Carlo (MC); David Lewis Hankin, Nice (FR)

(73) Assignee: Single Buoy Moorings Inc., Marly (CH)

( * ) Notice: Subject to any disclaimer, the term of this patent is extended or adjusted under 35 U.S.C. 154(b) by 172 days.

(21) Appl. No.: 12/375,233

(22) PCT Filed: Jul. 27, 2007

(86) PCT No.: PCT/EP2007/057759
§ 371 (c)(1),
(2), (4) Date: May 15, 2009

(87) PCT Pub. No.: WO2008/012358
PCT Pub. Date: Jan. 31, 2008

(65) Prior Publication Data

US 2009/0264033 A1 Oct. 22, 2009

(30) Foreign Application Priority Data

Jul. 27, 2006 (EP) ..... 06117993

(51) Int. Cl.
*B63B 22/02* (2006.01)

(52) U.S. Cl. ..... 441/5; 137/461; 441/4

(58) Field of Classification Search ..... 441/3, 4, 441/5; 137/461; 166/354; 405/195.1, 202, 405/206, 224.2
See application file for complete search history.

(56) References Cited

U.S. PATENT DOCUMENTS 4,262,380 A * 4/1981 Foolen ..... 441/3
(Continued)

FOREIGN PATENT DOCUMENTS

EP 0 059 499 9/1982
(Continued)

OTHER PUBLICATIONS

International Search Report dated Nov. 6, 2007, from corresponding PCT application.

*Primary Examiner* — Lars A Olson
(74) *Attorney, Agent, or Firm* — Young & Thompson

(57) ABSTRACT

System of a hydrocarbon transfer buoy and a vessel, the buoy having a length of at least 50 m and a length-to-width ratio of at least 10:1, and including a submerged buoyancy member having a length of at least 30 m and being situated at a depth of at least 10 m below water level, another support frame protecting above water level being connected to the top of the buoyancy member and carrying a support deck and a mooring buoy connector for attaching to a mooring arm connector of the vessel, which mooring arm connector is situated on an arm projecting outboard from the vessel's hull, the buoy being anchored to the sea bed via anchor lines which extend at an angle to a vertical direction, at least one hydrocarbon riser being attached to the buoy. The buoyancy member being connected to the sea bed via at least one substantially vertical taut tendon. The riser has a length of at least 500 m, and includes a steel riser part attached to the buoy, the riser extending up to the mooring buoy connector and being closable by a valve, the riser at its end including a connecting member for releasably attaching to a duct on the mooring arm connector.

20 Claims, 10 Drawing Sheets

U.S. PATENT DOCUMENTS

Figure 1:
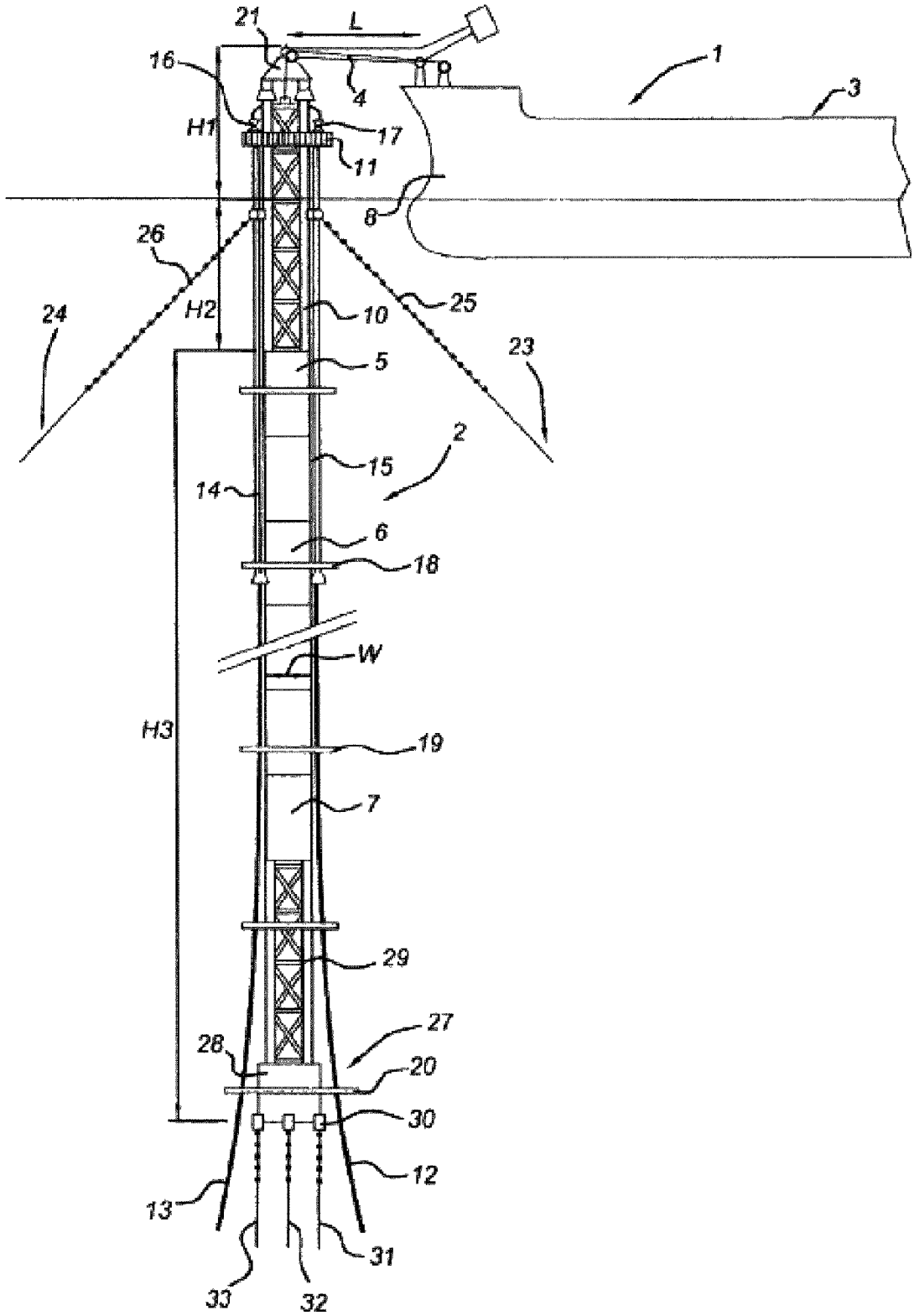

| | | | | |
|---|---|---|---|---|
| 4,281,611 | A * | 8/1981 | Vilain | 441/5 |
| 4,480,575 | A * | 11/1984 | Delamare | 441/5 |
| 4,490,121 | A | 12/1984 | Coppens et al. | |
| RE32,578 | E | 1/1988 | Poldervaart et al. | |
| 5,505,646 | A * | 4/1996 | Poldervaart et al. | 441/3 |
| 6,210,075 | B1 * | 4/2001 | Korloo | 441/4 |
| 6,769,376 | B2 * | 8/2004 | Perera et al. | 441/4 |
| 7,029,348 | B2 | 4/2006 | Bauduin et al. | |
| 7,044,156 | B2 | 5/2006 | Webster | |
| 2004/0052586 | A1 | 3/2004 | Horton, III | |
| 2008/0277123 | A1 | 11/2008 | Baross et al. | |

FOREIGN PATENT DOCUMENTS

| | | |
|---|---|---|
| FR | 2 560 849 | 9/1985 |
| GB | 2 401 164 | 11/2004 |
| WO | 02/092423 | 11/2002 |
| WO | 03/062043 | 7/2003 |
| WO | 2006/037964 | 4/2006 |

* cited by examiner

DEEP WATER HYDROCARBON TRANSFER SYSTEM

The invention relates to a system of a hydrocarbon transfer buoy and a vessel, the buoy having a length of at least 50 m and a length-to width ratio of at least 10:1 and comprising a submerged buoyancy member having a length of at least 30 m and being situated at a depth of at least 10 m below water level, an open support frame being connected to the top of the buoyancy member and projecting above water level, the support frame carrying a support deck and a mooring buoy connector for attaching to a mooring arm connector of the vessel, which mooring arm connector is situated on an arm projecting outboard from the vessel's hull, the buoy being anchored to the sea bed via anchor lines which extend at an angle to a vertical direction, at least one hydrocarbon riser being attached to the buoy.

Such a system is known from FR 2 560 849. The mooring system that is described in this publication shows a small slender buoy to which a number of flexible risers is attached. Flexible risers connect a sub sea well to the buoy. A tanker is attached to the top of the buoy via a rotating connector part at the end of a transverse arm that projects outboard from the bow of the vessel. The known mooring system is only suitable for use in water depths of a few hundreds of meters. Furthermore, no provisions are indicated for rapidly and easily establishing mechanical and fluid coupling of the mooring arm end with the top of the buoy.

It is an object of the present invention to provide a disconnectable deep water mooring and flow water buoy where multiple SCRs can be connected. It is also an object of the invention to provide a mooring system with limited excursions, which is suitable for use in large water depths. It is a further object of the present invention to provide a mooring system with improved stability and reduced weight. It is again an object of the present invention to provide a mooring system in which the risers can be guided along the buoy to assume a trajectory which reduces bending forces and which maintains the risers in a defined and stable position. It is another object of the present invention to provide a mooring system in which mechanical and fluid connections can be rapidly established and detached.

Thereto the system of the present invention is characterised in that the support frame is an open support frame, the buoyancy member being connected to the sea bed via at least one substantially vertical taut tendon, the riser having a length of at least 500 m and comprising a steel riser part attached to the buoy, the riser extending up to the mooring buoy connector and being closable by a valve, the riser at its end comprising a connecting member for releasably attaching to a duct on the mooring arm connector.

By mooring the buoy to the sea bed via both the lateral mooring system and one or more taut tendons, a heave stable buoy is obtained with relatively small pitch excursions, which in combination with a rigid riser, such as for instance steel catenary risers (SCR's) can be used for transporting hydrocarbons at high temperature and pressure (for instance 150° C. and 1000 bar at the well head) from water depths of over 500 m, such as 1 km and more without the risk of the risers buckling or collapsing.

The possibility of closing off the risers above water at the top of the buoy in combination with the mechanical connector on the vessel results in a quick disconnect capability in case of severe weather conditions or an emergency situation. As the buoy has an open upper support frame, near the surface where normal wave motions occur, it is very stable in relation to pitch and the pitch angle can be maintained below 15 degrees from the vertical. The direct connection of the steel risers to the stable slender buoy results in reduced motion of the risers and hence in reduced fatigue.

In one embodiment of a mooring system according to the present invention, the mooring arm connector comprises a mechanical connector having a turntable rotatable around a substantially vertical axis, at least one conical receiving member carried by the turntable for attaching to the mooring buoy connector, which mooring buoy connector comprises a substantially vertical pillar extending from the support deck, the turntable carrying piping with connectors at their ends for attaching to the connecting member at the upper riser end.

The conical connector provides for an easy and self-aligning mechanical connection which can be rapidly established and which is very reliable. Via the turntable, the vessel cannot only weathervane around the buoy but also the piping on the mooring arm connector can be rotated into the right coupling position either via a separate drive motor or by hand by the crew establishing the mechanical and the fluid connection with the buoy. The turntable is preferably connected to the mooring arm via a universal pivot joint rotatable around two perpendicular axes extending transversely to the mooring arm and substantially in the direction of the mooring arm, respectively, for allowing inclinations of the mooring buoy-axis relative to the vertical.

In one embodiment, the mooring arm connector carries one or more hydrocarbon swivels, with an inlet pipe section extending from one swivel part substantially vertically downward and an outlet pipe section in the direction of the arm, for allowing weathervaning of the vessel around the buoy.

The mooring arm connector may comprise a conical coupling surface, the mooring buoy connector comprising a cylinder with at its upper end a conical connecting rim complementary with the conical coupling surface. By the mating conical surfaces a stable and self-centering mechanical connection can be obtained.

The mooring buoy connector may comprise a cylinder having an open top end and comprising at least two stacked swivels, each swivel being with an inner ring connected to respective risers, an outer swivel ring being connected to outlet piping extending in the vertical direction towards a flow connecting member near the upper cylinder end for connection to the piping comprised within the conical coupling member. The swivel stack is protected by the encasing cylinder on the buoy providing man access for inspection and/or maintenance.

An attachment member, such as an hydraulically operated clamp, may be situated on the outer surface of the conical arm coupler, the clamp having engagement means for engaging with a transverse shoulder of a conical connecting rim on the cylinder. The attachment members clampingly pull the conical arm connector over the conical rim of the attachment cylinder for providing a firm mechanical connection.

At least two riser tubes may extend vertically along the support structure and along at least one buoyancy body, the tubes being below the support structure connected to the at least one buoyancy body. The riser tubes (or "I-tubes") guide the upper part of the risers along the buoy upwards to the connector deck along a defined trajectory, through the wave active zone and prevent relative movement of the risers with respect to the buoy. Below lower ends of the riser tubes, a number of transverse carriers may interconnect the rigid risers for providing lateral stiffness to the risers. The transverse carriers have riser receiving parts which for lower transverse carriers are spaced at a larger mutual distance than for upper transverse carriers so that the risers can follow their natural inclination. These lower transverse carriers also have progressively larger clearances to the riser and act as guides to gently bend the SCRs over some length as the buoy pivots.

The very long slender buoy of the present invention may have one or more buoyancy modules connected to the risers below the riser tubes, the buoyancy module comprising an air chamber that is in open communication with the environment. By the pressure compensated buoyancy module, buoyancy can be distributed along the length of the buoy without having to revert to very heavy reinforced buoyancy tanks that can withstand the high pressures prevailing at larger water depths.

At the lower end of the buoy, the risers may be interconnected via a truss structure, with at its bottom a ballast weight. The ballast weight may be comprised of fixed ballast, such as a concrete block, and may serve to connect the lower part of the buoy to the sea bed via one or more tendons. The tendons may be made of synthetic material, and are connected to a lower buoy part via an adjustable chain section in order to adjust the tension of the tendons upon installation or upon the tendons becoming slack over time.

Figure 2:
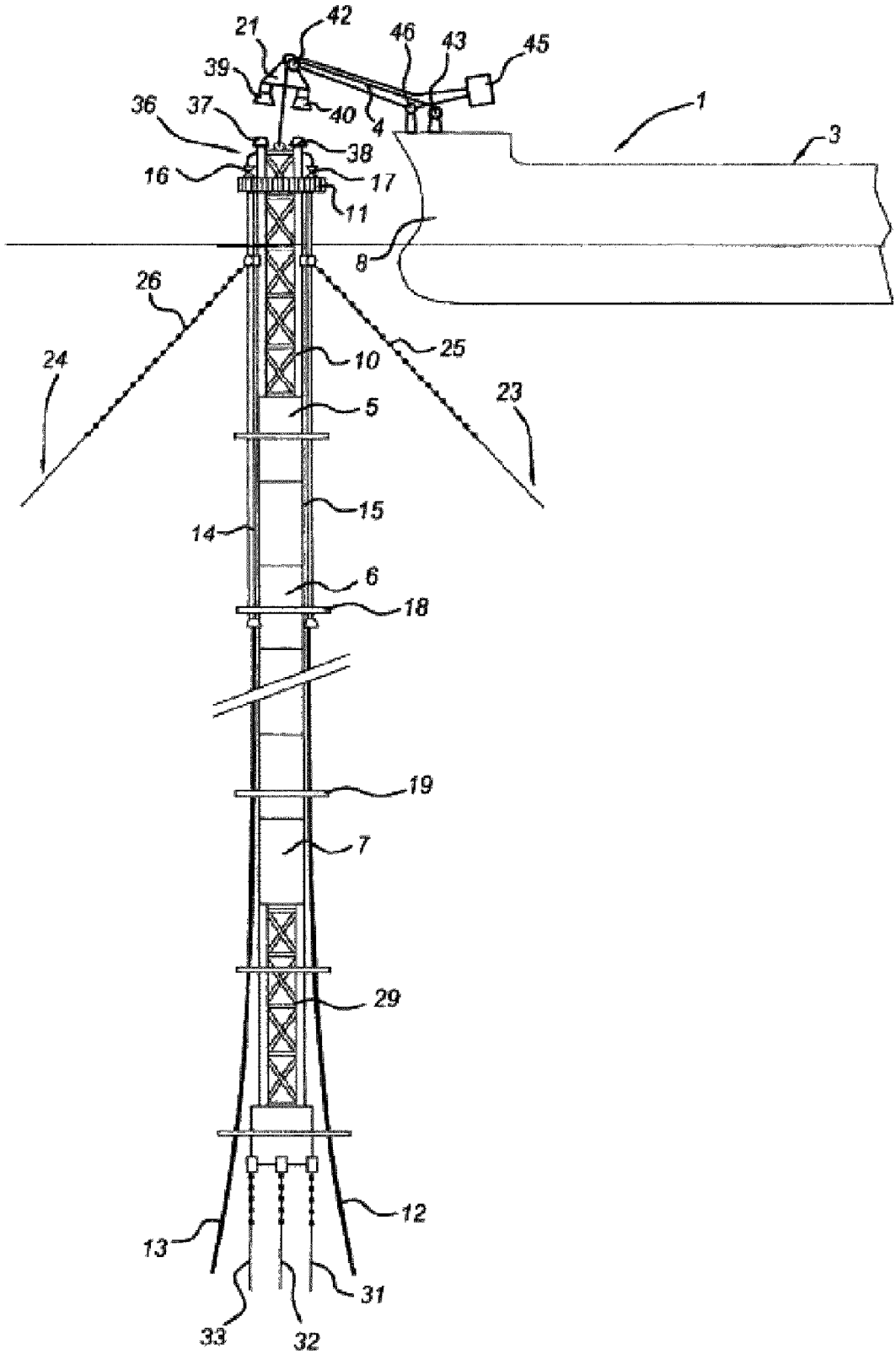
Figure 3:
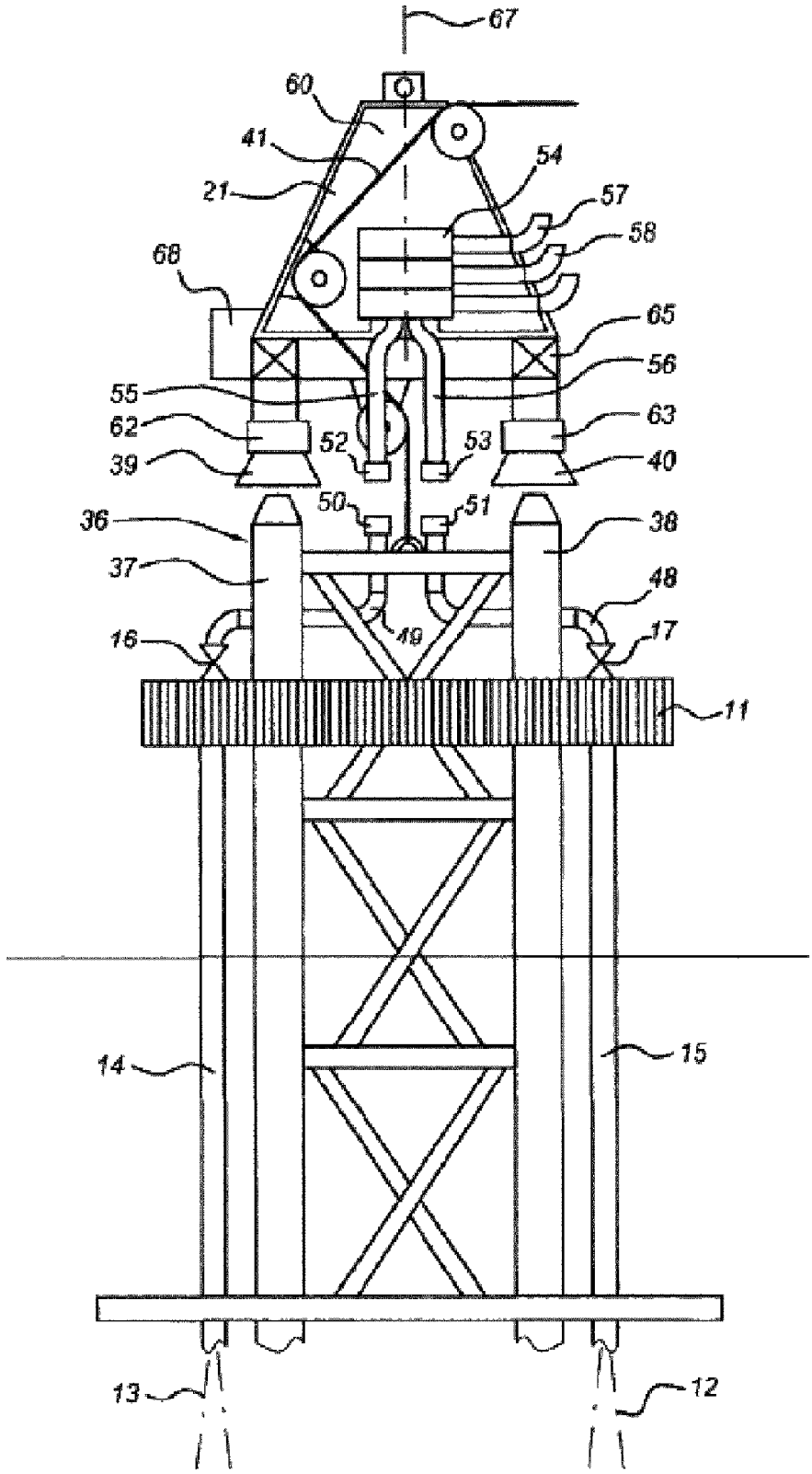
Figure 4:
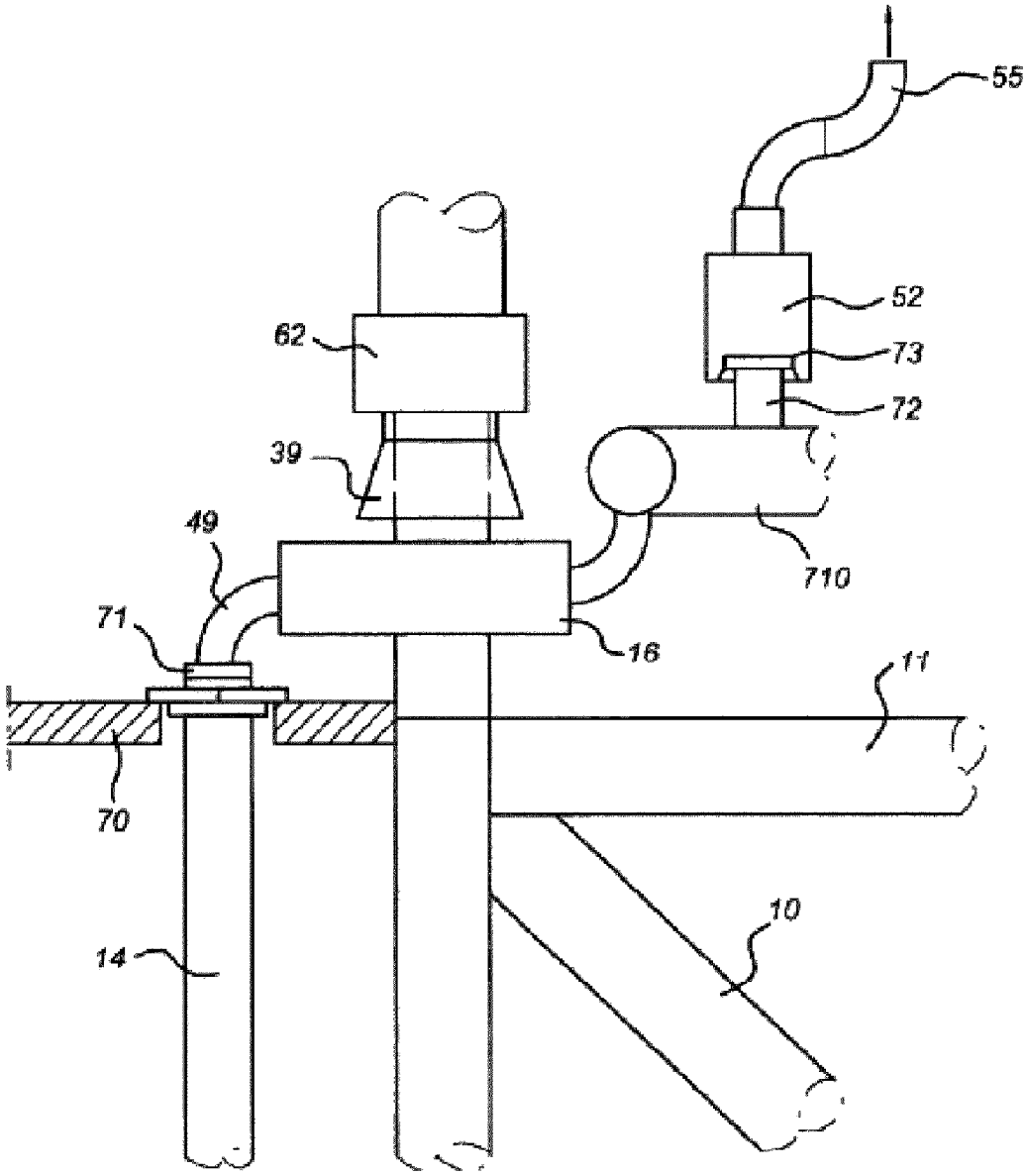
Figure 5:
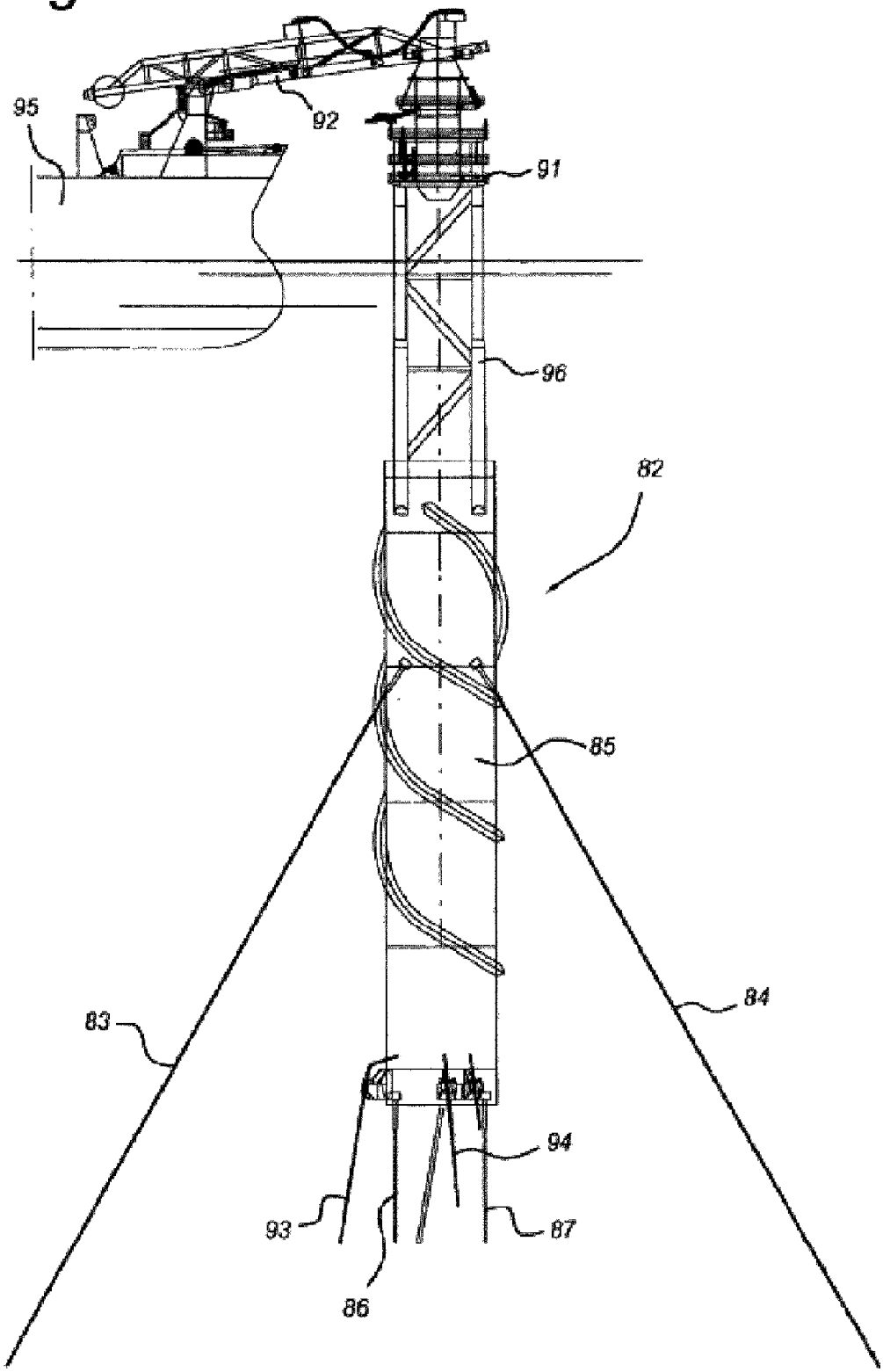
Figure 6:
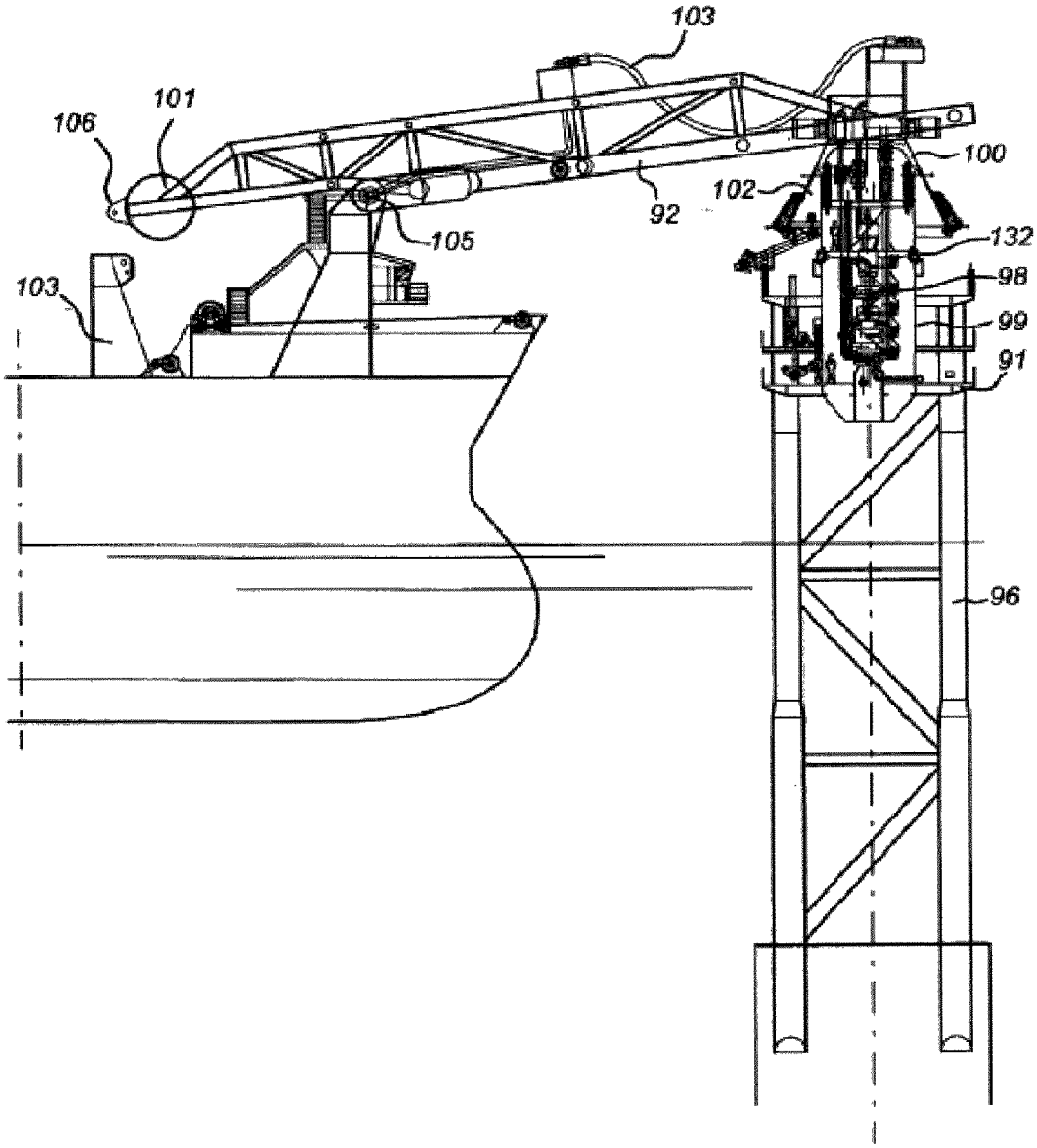
Figure 7:
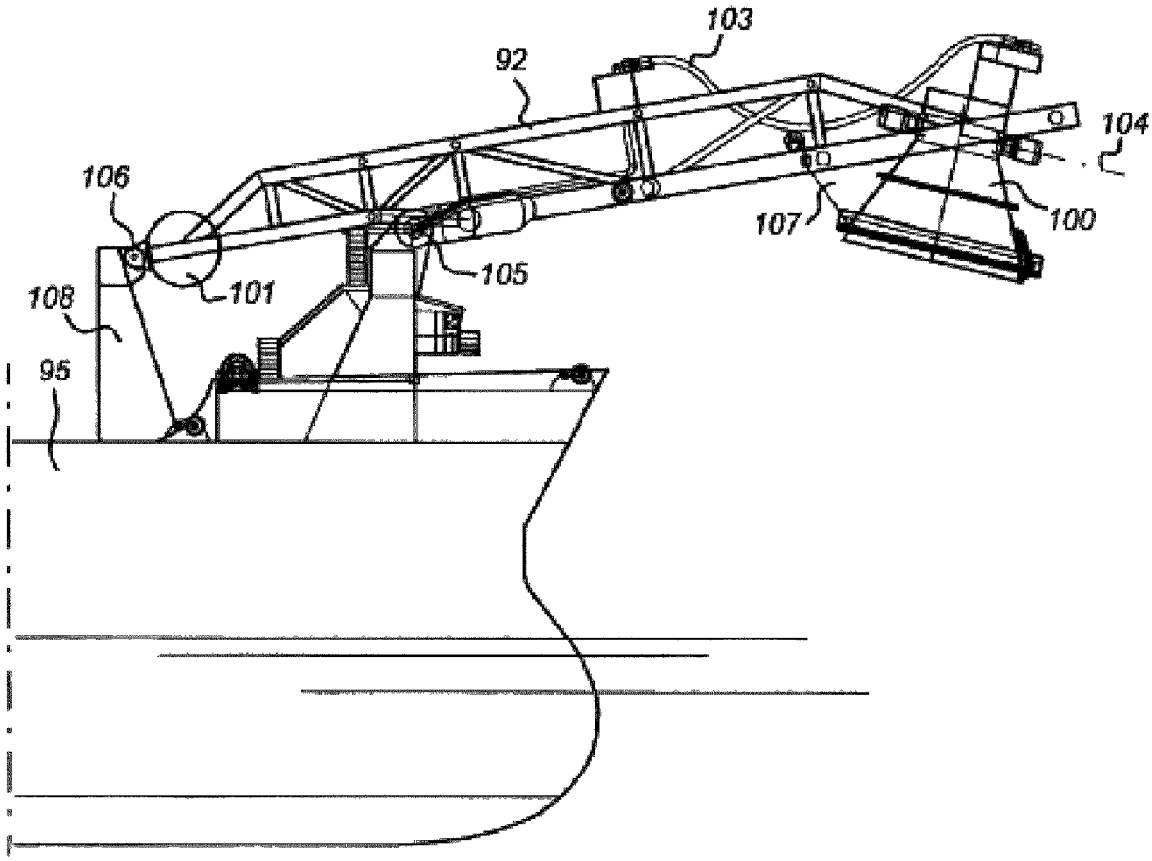
Figure 8:
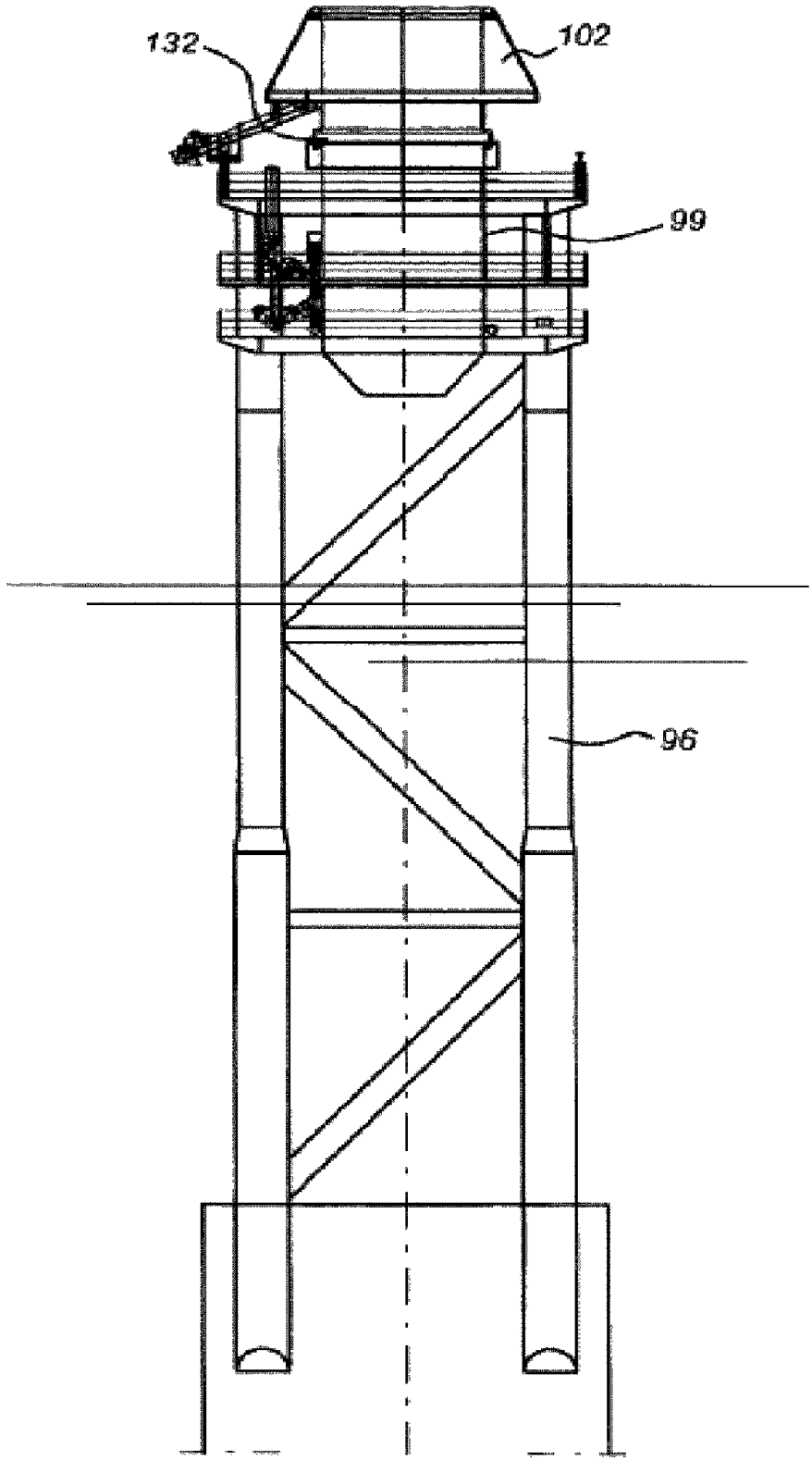
Figure 9:
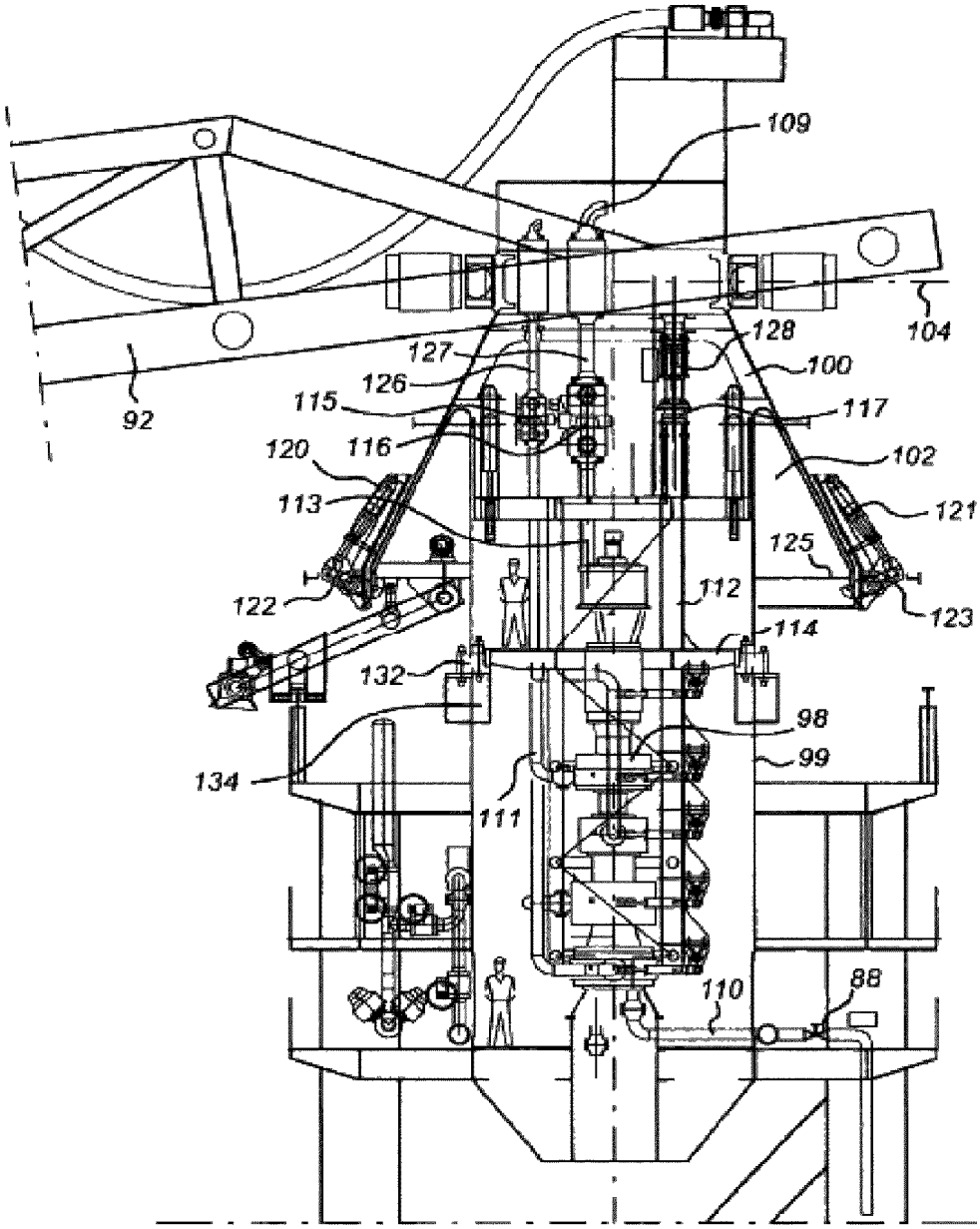
Figure 10:
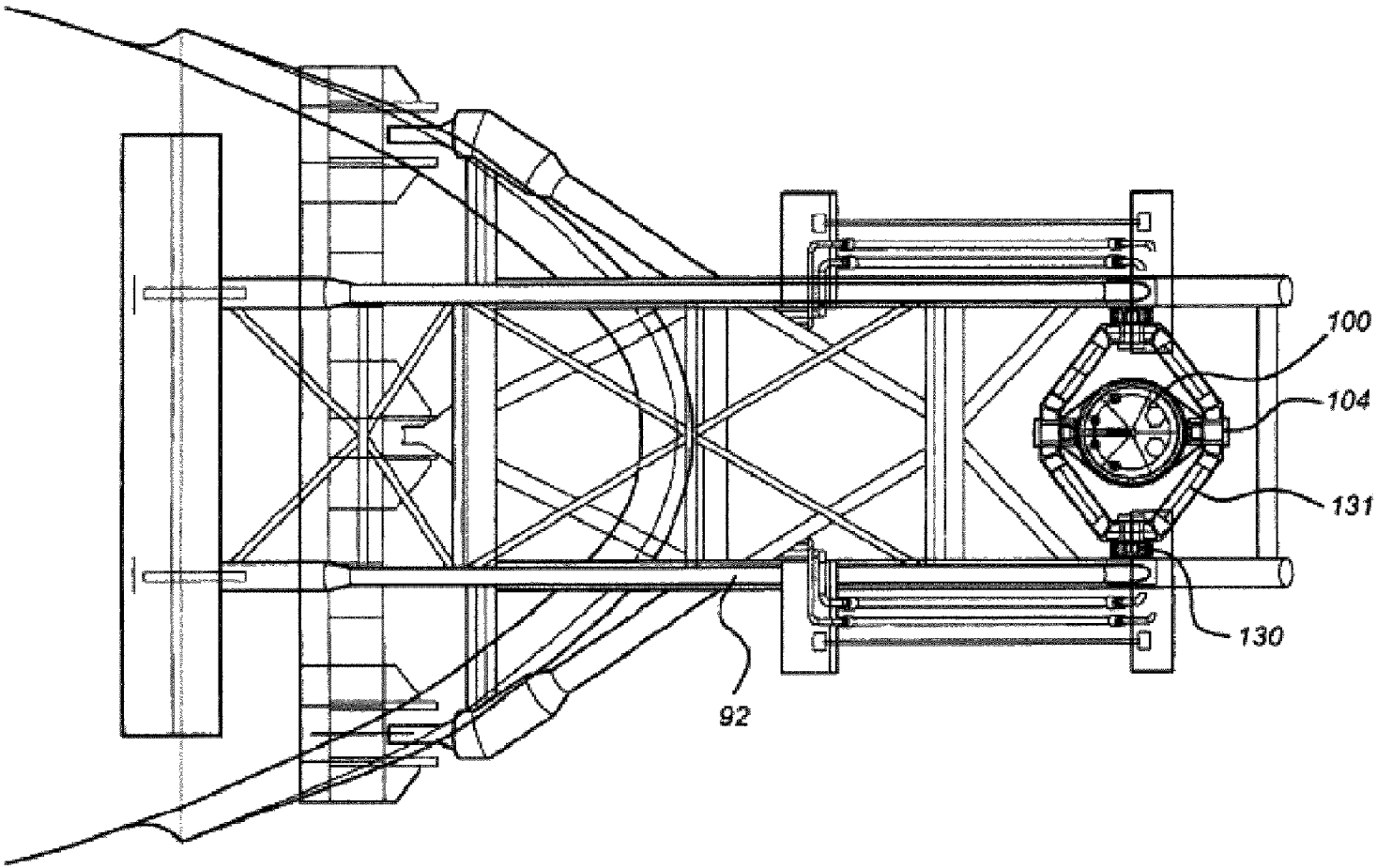

Some embodiments of a mooring system according to the present invention will be explained in detail with reference to the accompanying drawings. In the drawings:

FIG. 1 shows a side view of a first embodiment of the mooring system of the present invention with buoyancy modules distributed along the length of the buoy and a swivel attached to the mooring arm connector, FIG. 2 shows the mooring system of FIG. 1 in the disconnected state, FIG. 3 shows an enlarged detail of the connector and of the upper end of the mooring buoy of FIG. 1, FIG. 4 shows an enlarged detail of above water riser fluid connectors and a High Integrity Pressure Protection System (HIPPS) of the mooring buoy of FIG. 1, FIG. 5 shows a side view of a second embodiment of the mooring system according to the invention with a single buoyancy member and a swivel stack permanently connected to the buoy, FIG. 6 shows the upper part of the mooring system of FIG. 5 on an enlarged scale, FIG. 7 shows the mooring arm of the mooring system of FIG. 5, FIG. 8 shows the upper part of the mooring buoy of the mooring system of FIG. 5, FIG. 9 shows an enlarged detail of the mooring arm connector and the mooring buoy connector of the mooring system of FIG. 5 in the connected state, and FIG. 10 shows a top view of the mooring arm and the connector of FIG. 5.

FIG. 1 shows the hydrocarbon transfer system 1 comprising a mooring buoy 2 and a vessel 3 having a mooring arm 4. The mooring buoy 2 comprises a number of submerged buoyancy members 5, 6, 7 and a truss support structure 10 carrying a support deck 11. Steel risers 12, 13 are guided from a sub sea well to the support deck 11. The upper parts of the risers 12, 13 are guided by riser tubes, or "I-tubes" 14, 15. The risers are each terminated near the riser support deck 11 in a valve 16, 17, closing off each riser. The arm 4 on the vessel 3 carries at its end a connector 21 for mechanically connecting to the upper buoy end and for providing a fluid connection between the risers 12, 13 and piping extending via the connector 21 and the arm 4 to the vessel 3.

The buoy 2 comprises lateral mooring lines 23, 24 each extending at an angle of about 45 degrees and attaching the buoy to the sea bed. The lateral mooring lines limit the pitch and surge motions of the buoy 2 and prevent the rigid risers 12, 13 from assuming a too vertical position which could cause it to fracture near the riser's curved part near the sea bed. The lateral mooring lines 23, 24 may be comprised of multi-strand cables of steel or polyester and may have upper chain sections 25, 26 for readjustment of the tension in the lateral mooring lines upon stretch. The lower parts of the lateral mooring lines near the sea bed are made of chain sections to avoid damage to the mooring lines by contact with sand and rocks.

The combined open structure of the truss support 10 in the wave active zone, the lateral mooring lines 23, 24 and the distribution of the buoyancy below the water line result in a very stable buoy 2 and in reduced wave-induced motions of the buoy 2 and the supported risers 12, 13. Under regular mooring conditions at small sea states, the pitch of the buoy 2 is limited to less than 15 degrees or less than 10 degrees from the vertical which results in reduced fatigue of the rigid steel risers 12, 13.

At the lower end 27 of the buoy 2, a ballast weight 28 is attached via a lower truss structure 29. A number of taut tendons 31, 32, 33 is connected to the lower end via connectors 30 and adjustable upper chain sections. The tendons may be comprised of metal cables, tensioned polyester cables with upper chain sections, as are well known in the art. If cables are used they may be terminated with heavy catenary chains or clumps near the seafloor. The weight and/or length of these chains or clumps distributed would, to a large part, determine the vertical stiffness of these near vertical cables.

The height H1 of the buoy and attached mooring arm connector 21 may comprise for instance 24 m, whereas the length L by which the arm 4 projects beyond the hull 8 of the vessel 3 may be 30 m. The truss support structure 10 extends for instance 30 m below water level, such that even during severe storms, the open structure prevents that wave motions impart significant dynamic motions to the risers. The height H3 of the lower buoy section may be 120 m, whereas the width W may be 12 m.

At least the lower buoyancy modules 6, 7 are preferably formed by pressure balanced tanks, which comprise air chambers in open communication with the environment. This prevents the need for a heavy and reinforced construction for the tanks to withstand the water pressure at larger depths.

The buoy 2 comprises distributed along its length a number of damping plates 18, 19 and 20 which can be connected to the riser I-tube or surround the lower risers via elastomeric bending guides. The damping plates limit the heave motions of the buoy. The lower bending guides have progressively larger holes that surround the risers. These guides therefore act to gently spread the riser bending over a longer length so as not to cause any unacceptable riser strain where the buoy pivots to its design angles.

FIG. 2 shows the position of the mooring arm 4 and the arm connector 21 during attachment of the connector 21 to the buoy connector 36, which comprises three or more pillars 37, 38 extending upwardly from the connection deck 11 for cooperating with stab guides 39, 40 on the connector 21. A cable 41 is attached to the buoy connector 36 and is guided via a sheave 42 to a winch 43 on the vessel 3. By pulling in the cable 41, the arm 4, which is balanced by a counterweight 45 in an upward direction, is pulled downward and pivots around pivot axis 46 until the stab guides 39, 40 slide over the pillars 37, 38 to establish a mechanical connection. During this operation, the valves 16, 17 at the top of the support deck 11 are closed. After connecting the riser top ends with fluid ducts in the connector 21, the valves can be opened and cable 41 is disconnected.

FIG. 3 shows the mooring arm connector 21 and the buoy connector 36 on an enlarged scale. The risers 12, 13 are with their upper ends attached to the support deck 11, and are closed off by the valves 16, 17. Connection piping 48, 49 extends vertically upwards, and is provided with end connectors 50, 51 for attaching in a fluid tight manner to complementary connectors 52, 53 of piping connecting to swivel stack or a swivel device 54. The fluid swivels in the swivel stack 54 are contained in a housing 60 of the mooring arm connector 21. Each swivel comprises an inner ring, attached to a vertical duct 55, 56 and an outer ring, rotatably connected to the inner ring, attached to horizontal ducts 57, 58, each ring comprising a fluid chamber. The inner rings and associated vertical ducts 55, 56 are rotationally stationary, whereas the horizontal ducts 57, 58 and outer swivel rings can rotate together with the arm 4 upon weathervaning of the vessel 3 around the buoy 2. The stab guides 39, 40 and clamps 62, 63 which can clampingly engage with the pillars 37, 38, are connected to the housing 60 of the connector 21 via a yaw bearing 65 for rotating the housing 60, the outer swivel rings and associated ducts 57, 58 around vertical axis 67. A drive motor 68 is provided for yaw rotating the lower part of connector 21 with respect to the housing 60 around the axis 67 for aligning the vertical ducts 55, 56 on the connector 21 with the piping 48, 49 on the buoy 2 prior to establishing mechanical and fluid connection.

FIG. 4 shows an enlarged detail of the connection of the riser tube 14 to the support deck 11 via a split support flange 70. The riser 13 that is contained within I-tube 14 is with an upper end supported on the riser I-tube 14 via a production riser flange 71. The connection piping 49 connects the riser upper end to the valve 16, which can comprise a HIPPS-type valve (High Integrity Pressure Protection System) of the type as described in U.S. Pat. No. 7,044,156. The valve 16 is in fluid communication with a production manifold 710, which may comprise a ring duct having transverse duct sections 72 with a connection flange 73 that releasably connects with hydraulic pipe connector 52 which in turn is attached to duct 55 of the swivel 54. The clamps 62, 63 are for instance formed of a VETCO H-4 type structural connector. The clamps 62, 63 are used to attach to truss structure 10.

In the embodiment of the mooring system of FIG. 5, the buoyancy member 85 of the buoy 82 is comprised of a single body, to which the steel catenary risers 93, 94 are connected near the bottom. The connection of the risers 93, 94 to the buoy 85 are made using, for example, elastomeric spherical flex-joints or metal stress joints designed to be connected to floating systems having limited pivot angles. The small pitch of the buoy 82 makes the use of these joints guide acceptable. Above the attachment point the bearing fixed risers are directed up a central shaft in the buoy. The risers can then be routed up through the vertical legs of truss 96 or independently up through the centre of the truss. Once these risers reach the deck 91 they can be routed through a HIPPS system to the upper structure piping. Transverse mooring legs 83, 84 and vertical tendons, or tethers 86, 87 connect the buoyancy member 85 to the sea bed. The support deck 91 on the truss support structure 96 carries a mechanical connector and a swivel stack, which in this embodiments remains with the buoy upon disconnecting of the mooring arm 92 of the vessel 95.

As can be seen from FIG. 6, a swivel stack 98 is situated substantially within a cylindrical housing 99 on the support deck 91. The cylindrical housing 99 at its upper end supports the weathervaning bearing 132 upon which a rotatable cylinder 102 with an outer conical connecting flange is attached. A conical connector 100 is attached at the end of the arm 92 via a universal joint so as to be able to pivot around an axis that is perpendicular to the plane of the drawing and around an axis 104 extending generally in a length direction of the arm 92. The conical connector 100 engages with the outer conical connecting flange of rotatable cylinder 102 for establishing a mechanical connection. The fluid connectors for connecting the swivel stack 98 to flexible ducts 103 on the arm 92, are accommodated within the mooring arm connector 100 near the upper edge of the cylindrical swivel stack housing of the cylinder 102. In the connected state, the arm 92 can pivot around pivot point 105 when an arm locking mechanism 106 at the back end of the arm is released.

In FIG. 7, the arm 92 and the arm connector 100 are shown in the disconnected state. The connector 100 is pulled back via a pull-in cable 107 towards the bow of the vessel 95. The arm 92 is pivoted upwards around the pivot point 105 by the counterweight 101, whereas the back end of the arm 92 is locked in position by the locking mechanism 106 at the end of post 108.

FIG. 8 shows the cylindrical swivel stack housing 99 with supporting bearing 132 and cylinder 102 with the conical coupling flange. As can be seen from FIG. 9, the inner rings of the swivels in the swivel stack are connected to the risers via an inlet manifold 110 and valve 88. Via the rotating outer rings of the swivels, the hydrocarbons are transferred to ducts 111, 112, 113, extending vertically upwards to connectors 115, 116, 117. The connector 100 is supported at the end of the arm 92 via the cylinder 102 on the bearing 132 such as to be rotatable around the vertical axis 109, together with the outer swivel rings, the ducts 111, 112, 113, the connectors 115, 116, 117, the piping 127, 128, 129 on the connector 100 and the deck 114. After contacting the conical coupling surface of the connector 100 with the conical flange, the hydraulic locking arms 120, 121 on the outer surface of the connector 100 rotate grippers 122, 123 under a transverse shoulder 125 of the flange 102 to lock the connector 100 onto the conical flange. After establishing the mechanical connection, the connectors 115, 116 and 117 are actuated to connect the outlet piping of the swivels in the swivel stack 98 to the piping 126, 127, 128 on the connector 100, which piping is in fluid connection with flexible hoses 103 on the arm 92.

It is possible to rotate the outer swivel on the buoy using a driving motor 134 connected to bearing 132. Once the mooring connection is secured, the motor will rotate the rotating part of the buoy 102 to align swivel piping with piping in connector 100. When the pipings are aligned locking pins on the rotating part 102 are hydraulically activated and interconnected and lock the fixed part 99 and rotating part 102 together. Subsequently the risers connecting members of both parts are connected so to establish a leak free fluid path after the HIPPS.

FIG. 10 shows a top view of the arm 92, which may comprise a Y-frame, carrying at its end the universal joint 131, in which the connector 100 is supported such that it can pivot around the perpendicular axes 104, 130.

The invention claimed is:

1. System of a hydrocarbon transfer buoy (2, 82) and a vessel (3, 95), the buoy having a length ($H_1$, $H_2$, $H_3$) of at least 50 m and a length-to-width ratio of at least 10:1, and comprising a submerged buoyancy member (5, 6, 7, 85) having a length of at least 30 m and being situated at a depth of at least 10 m below water level, an open support frame (10, 96) being connected to the top of the buoyancy member (5, 6, 7, 85) and projecting above water level, the support frame carrying a support deck (11, 91) and a mooring buoy connector (36, 99, 102) for attaching to a mooring arm connector (21, 100) of the vessel, which mooring arm connector (21, 100) is situated on an arm (4, 92) projecting outboard from the vessel's hull (8, 95), the buoy being anchored to the sea bed via anchor lines (23, 24, 83, 84) which extend at an angle to a vertical direction, at least one hydrocarbon riser (12, 13, 93, 94) being attached to the buoy, the buoyancy member being connected to the sea bed via at least one substantially vertical taut tendon (31, 32, 33, 86, 87), the riser (12, 13, 93, 94) having a length of at least 500 m, and comprising a steel riser part attached to the buoy, the riser extending up to the mooring buoy connector (36, 99, 102) and being closable by a valve (16, 17, 88), the riser at its end comprising a connecting member (50, 51, 115, 116, 117) for releasably attaching to a duct (55, 56, 126, 127, 128) on the mooring arm connector (21, 100).

2. System according to claim 1, wherein the mooring arm connector (21, 100) comprises a mechanical connector having a turntable (65, 132) rotatable around a substantially vertical axis (67, 109), at least one conical receiving member (39, 40, 100) carried by the turntable (65, 132) for attaching to the mooring buoy connector, which mooring buoy connector comprises a substantially vertical pillar (37, 38, 99) extending from the support deck (11, 91), the turntable carrying piping (55, 56, 126, 127, 128) with connectors (52, 53, 115, 116, 117) at their ends for attaching to the connecting member (50, 51, 115, 116, 117) at the upper riser end.

3. System according to claim 1, wherein the risers (93, 94, 12, 13) extend to the support deck (11, 91) above water level, wherein the riser upper ends are connected to a valve (16, 88) which is in fluid communication with upper piping connected to the vessel (3, 95), which valve (16, 88) comprises a HIPPS system protecting the upper piping from pressure surges that may travel up the risers.

4. System according to claim 2, wherein a drive motor (134) is connected to the bearing of the turntable (132) so as to align the pipe ends of the piping of the turntable (132) with upper riser ends after the mooring arm is connected.

5. System according to claim 2, wherein the turntable (65, 132) is connected to the mooring arm (4, 92) via a first pivot axis (130) extending substantially transversely to the vertical and length direction of the arm, and a second pivot axis (104) extending generally in the length direction of the arm.

6. System according to claim 2, wherein the mooring arm connector (21, 100) comprises a housing (60) carrying at least one swivel (54), having an inlet pipe section (55, 56) extending in a substantially vertical direction for connecting to the riser connecting member (50, 51), and an outlet pipe section (57, 58) extending from the swivel (54) in the direction of the arm (4).

7. System according to claim 2, wherein the mooring arm connector (100) comprises a conical coupling surface, the mooring buoy connector comprising a cylinder (99) with at its upper end a rotatable member having a conical connecting rim (102) complementary with the conical coupling surface.

8. System according to claim 5, wherein the cylinder (99) has an open top and comprises at least two stacked swivels (98), each swivel being with an inner ring connected to a respective riser, an outer swivel ring being connected to outlet piping (111, 112, 113) extending in the vertical direction to a riser connecting member (115, 116, 117) near the upper cylinder end for connection to the piping (126, 127, 128) comprised within the mooring arm connector (100).

9. System according to claim 5, wherein an attachment member (120, 121) is situated on the outer surface of the conical arm connector (100) with engagement means (122, 123) for engaging under a transverse shoulder (125) of the conical connecting rim (102).

10. System according to claim 1, wherein at least two riser tubes (12, 13) extend vertically along the support structure and along at least one buoyancy body (5, 6, 7), the tubes being below the support structure (10) connected to the at least one buoyancy body (5, 6, 7).

11. System according to claim 10, wherein below lower ends of the riser tubes (14, 15) a number of transverse carriers (18, 19, 20) interconnect the rigid risers (12, 13).

12. System according to claim 11, wherein the transverse carriers (18, 19, 20) have riser receiving parts which for lower transverse carriers are spaced at a larger mutual distance than for upper transverse carriers and the lower carriers constructed so as to guide and/or bend the risers.

13. System according to claim 10, wherein a buoyancy module (5, 6, 7) is connected to the risers (12, 13), the buoyancy module comprising an air chamber that is in communication with the environment.

14. System according to claim 11, wherein at the lower end of the buoy the risers are interconnected via a truss structure (29), with at its bottom a ballast weight (28).

15. System according to claim 7, wherein the tendons (31, 32, 33) are made of metal or synthetic material, and are connected to a lower connecting part via an adjustable chain section.

16. System according to claim 2, wherein the risers (93, 94, 12, 13) extend to the support deck (11, 91) above water level, wherein the riser upper ends are connected to a valve (16, 88) which is in fluid communication with upper piping connected to the vessel (3, 95), which valve (16, 88) comprises a HIPPS system protecting the upper piping from pressure surges that may travel up the risers.

17. System according to claim 3, wherein a drive motor (134) is connected to the bearing of the turntable (132) so as to align the pipe ends of the piping of the turntable (132) with upper riser ends after the mooring arm is connected.

18. System according to claim 6, wherein an attachment member (120, 121) is situated on the outer surface of the conical arm connector (100) with engagement means (122, 123) for engaging under a transverse shoulder (125) of the conical connecting rim (102).

19. System according to claim 11, wherein a buoyancy module (5, 6, 7) is connected to the risers (12, 13), the buoyancy module comprising an air chamber that is in communication with the environment.

20. System according to claim 12, wherein a buoyancy module (5, 6, 7) is connected to the risers (12, 13), the buoyancy module comprising an air chamber that is in communication with the environment.

* * * * *